United States Patent [19]

Kusters et al.

[11] 3,945,131

[45] Mar. 23, 1976

[54] WEB DRYING APPARATUS

[75] Inventors: Eduard Küsters; Kurt Quoos, both of Krefeld, Germany

[73] Assignee: Eduard Küsters, Krefeld, Germany

[22] Filed: Nov. 7, 1974

[21] Appl. No.: 521,857

Related U.S. Application Data

[63] Continuation of Ser. No. 36,851, May 13, 1970, abandoned.

[52] U.S. Cl. ..... 34/122; 68/158; 68/DIG. 5; 15/307

[51] Int. Cl.[2] ..... F26B 11/02

[58] Field of Search ..... 34/108–123, 34/151–155, 162, 148; 15/304–307; 68/18, 20, 5 D, 150, 158, 184, DIG. 5; 165/107, 105, 116, 119

[56] References Cited

UNITED STATES PATENTS

| | | | |
|---|---|---|---|
| 1,715,830 | 6/1929 | Glinka | 34/122 |
| 2,123,304 | 7/1938 | Hetzer | 34/131 |
| 3,430,356 | 3/1969 | Fleissner et al | 34/122 |
| 3,828,589 | 8/1974 | Collinge | 15/307 |

*Primary Examiner*—Kenneth W. Sprague
*Assistant Examiner*—James C. Yeung
*Attorney, Agent, or Firm*—Kenyon & Kenyon Reilly Carr & Chapin

[57] ABSTRACT

Apparatus for drying a traveling web which is permeable to air, has a rotating foraminous drum on which the web is wrapped and screw-type propellers mounted in each end of the drum, the diameters of the propellers closely approaching the inside diameters of the drum. Rotation of the propellers effects suction in the drum. Provision is made for heating air to be sucked through the web into the drum, and optionally for recirculating more or less of the air flowing from the ends of the drum back to the drum's periphery.

10 Claims, 2 Drawing Figures

INVENTORS
EDUARD KÜSTERS
KURT QUOOS

BY
Kenyon & Kenyon Reilly Carr & Chapin
ATTORNEYS

INVENTORS
EDUARD KÜSTERS
KURT QUOOS
BY
Kenyon & Kenyon Reilly, Carr & Chapin
ATTORNEYS

WEB DRYING APPARATUS

This is a continuation, of application Ser. No. 36,851, filed May 13, 1970 now abandoned.

BACKGROUND OF THE INVENTION

This invention relates to web drying apparatus for drying textile webs although it may be used for any webs which are permeable to air. In the case of the textile webs, after being dyed or otherwise impregnated with liquid, drying to a predetermined degree of moisture content is ordinarily necessary. The invention is particularly intended for this kind of use.

It is old to dry a traveling textile web by wrapping it around the periphery of a rotating foraminous drum. Air, which may be heated, is driven into the drum so that it is forced outwardly through the web to carry away liquid in the web. The drum is enclosed by a casing which collects the moist air.

The above prior art drying has the disadvantage that it cannot accommodate different widths of textile webs, because the nonadjustable foraminous drum surface should be covered rather exactly by the web axially with respect to the drum. Another disadvantage is that with the casing enclosing the moist air, control of the desired degree of dryness present problems.

SUMMARY OF THE INVENTION

According to the present invention, the foraminous drum about which the web is wrapped has open ends in each of which a screw-type propeller is positioned. the propeller's diameters closely approach the inside diameters of the drum and they are rotated in directions effecting suction in the drum. The air is sucked inwardly through the web and into the drum from which it exhausts through the drum's open ends. The propellers are mounted so that they may be moved axially with respect to the drum's ends and therefore they may be adjusted to positions substantially registering with the edges of the web regardless of the latter's exact width. In this way the air is drawn only through the web and not through the drum portions extending beyond the web's edges.

An enclosure forms a chamber around the drum's periphery and has openings through which the drum's ends project and, of course, the necessary entrance and exit for the traveling web. This enclosure has an air inlet which may be supplied with a heating means.

Control of the moisture content of air sucked through the enclosure's inlet is made possible by a casing which forms a chamber around the above enclosure and the drum's ends, this casing having walls extending tansversely with respect to the drum's ends and spaced therefrom and in which outlet openings are formed substantially opposite to the drum's ends. The casing has an inlet opening through which air is sucked with the moist air flowing from the drum's ends going through the casing's outlet openings. These openings have shutters which may be controlled so that more or less of the air flowing from the drum's ends may be recirculated within the casing back to the enclosure's inlet. By providing the casings inlet with shutters, complete recirculation of the air is made possible.

DESCRIPTION OF THE ILLUSTRATED INVENTION

Figure 1:
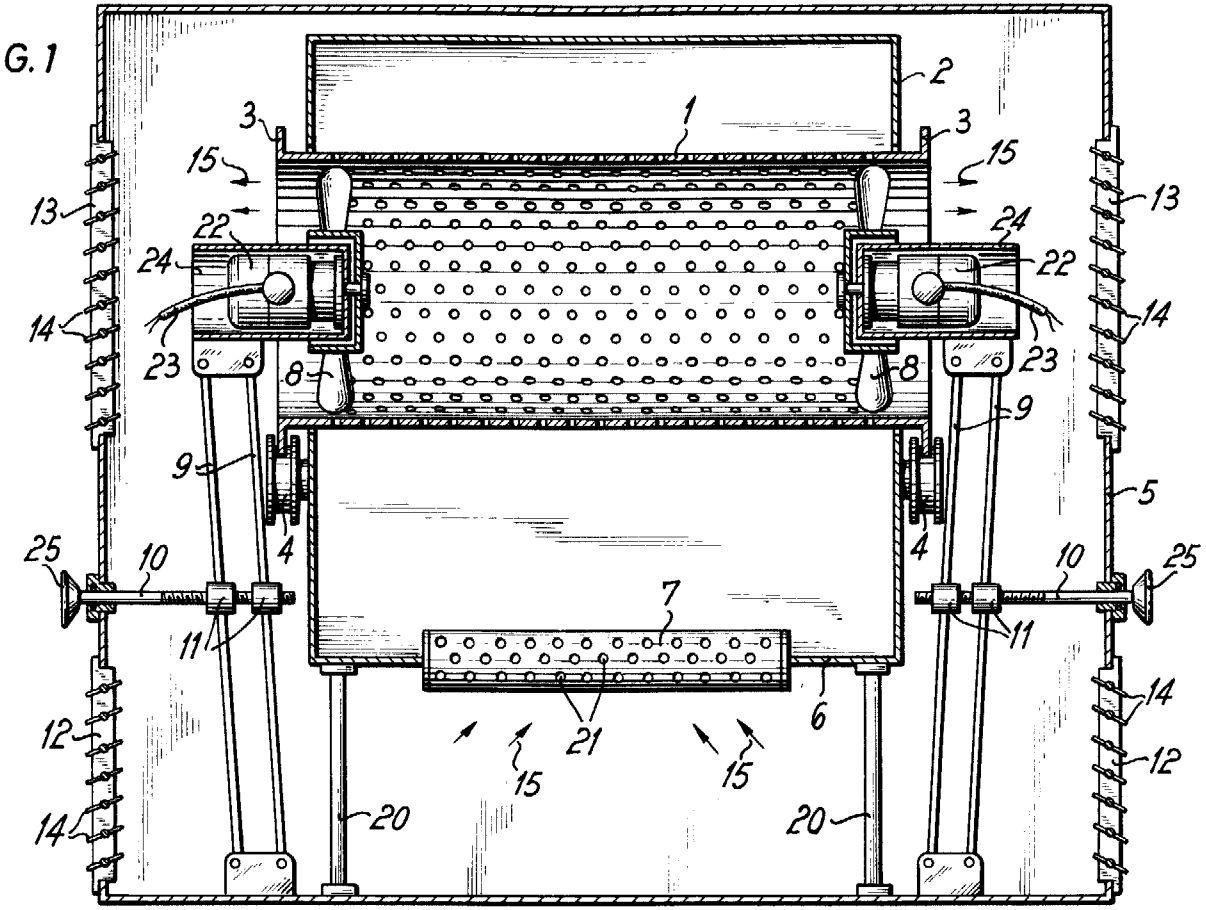
FIG. 1 is a vertical transverse section of the new apparatus.

Referring first to FIG. 1, the foraminous drum 1, which may be a perforated cylinder, is horizontally arranged in the enclosure 2 having openings through which the ends of the drum project. These ends have flanges 3 supported by horizontally interspaced saddle rollers 4 so that the open ends of the drum 1 are free from interfering parts. The enclosure 2 forms a chamber surrounding the periphery of the drum 1.

The enclosure 2 and the open ends of the drum 1 are all enclosed by a casing 5 which forms a completely surrounding chamber. The bottom wall 6 of the enclosure 2 has an air inlet 7. Screw-type propellers 8, or fans, are mounted in each end of the drum 1 and these propellers are rotated in directions effecting suction within the drum 1. Air is drawn into the enclosure 2, radially inwardly through the drum 1 and propelled outwardly through the open ends of this drum.

Although not shown by the drawings, both the enclosure 2 and the casing 5 may have an entrance and exit for the traveling web and various guide rollers, not shown, are arranged to partially wrap the traveling web around the drum 1. The more extensive the wrap, the less is the suction loss. Liquid is removed from the web radially inwardly into the drum 1 and expelled from its open ends. The arrangements mounting the propellers or fans 8 are in each instance supported through parallel pivoting legs 9 by the bottom of the casing 5 and these legs may be swung in each instance by a screw 10 threaded through nuts 11 fixed to the arms 9. These parallelogram arrangements permit rotation of the screws 10 to move the propellers 8 axially with respect to the drum 1 with very little motion radially with respect to this drum. Therefore, the propellers 8 may be made with diameters very closely approaching the inside diameter of the drum 1.

Now it is apparent that with the web wrapped partly, and usually to the fullest extent possible, around the drum 1, axial adjustment of the propellers 8 is possible to make them register with the edges of the web. This permits the air to be drawn inwardly only through the web regardless of the web's exact width.

At the bottom portion of the casing 5, its vertical walls are provided with air inlet openings 12. In alignment with the open ends of the drum 1, air outlet openings 13 are formed. The openings 13 should have at least approximately the area of the open end of the drum 1 with which the opening is opposite. All of the openings 12 and 13 are provided with adjustable shutter slats 14 which may be adjusted in the manner of Venetian blind slats.

With all of the shutters 14 open, air is drawn inwardly through the openings 12, as shown by the arrows 15, upwardly through the enclosure's inlet 7, through the web into the drum 1 and, as shown also by arrows 15, expelled through the openings 13 to the outer atmosphere. If all of the shutters are closed, complete recirculation of air expelled from the drum's open ends is effected. By various adjustments of the shutters 14, any degree of humidity control is made possible so that the web drying effect is under complete control.

Figure 2:
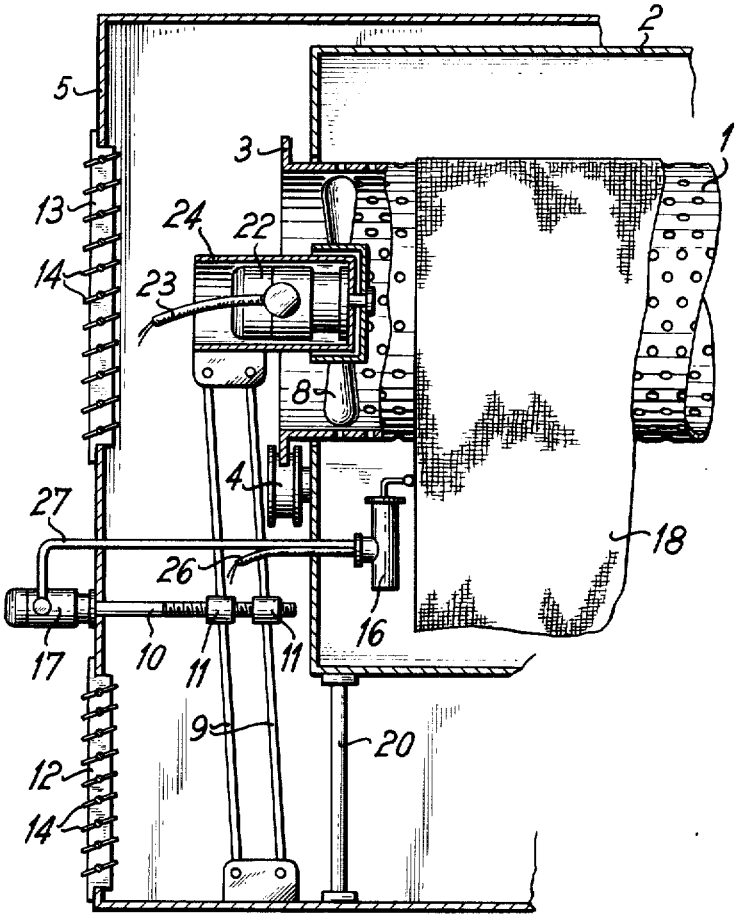
FIG. 2 shows the left-hand portion of FIG. 1 with a modification added.

Referring now to FIG. 2, a sensing device 16 is shown as having a web edge feeler and controlling an electric motor 17 which, in this instance, rotates the screw 10 so that the legs 9 are swung. In FIG. 2, the web 18 is shown, the intent being that when the sensing device senses the edge of this web 18, it will control the motor 17 so that the propeller 8 is axially moved into at least approximate registration with the edge of the web 18. In the case of a web of the narrow width shown by FIG. 2, it may be necessary to proportion the parts somewhat differently than illustrated to produce the desired action.

As illustrated by both FIGS. 1 and 2 the enclosure 2 is supported within the casing 5 by vertical legs 20. In FIG. 1 the air inlet 7 is shown as being provided with air heaters 21 which may be of the electric resistance heating type. The propellers 8 are mounted by the shafts of electric motors 22 powered by flexible electric cables 23 and mounted in casings 24 supported on the upper ends of the swinging legs 9. In FIG. 1 the screws 10 are manually turned by hand knobs 25.

In FIG. 2 the sensing device 16 is electrically powered by flexible electric conductors 26 with the control wiring for the device 16. Although not shown, this pipe may be made to adjustably locate the sensing device 16. Incidentally, it is to be understood that although FIG. 2 shows only the left-hand side of the apparatus, that the right-hand side is made to correspond.

What is claimed is:

1. In apparatus for the removal of moisture from air permeable material webs such as in the dyeing of dyed fabrics, finished facbrics and the like, comprising a rotating foraminous drum over which the web passes, a housing in which said drum is supported for rotation and fans, disposed in the end of the drum and supported to be adjustable longitudinally, to draw air through the periphery of the drum over a predetermined circumferential zone of the drum over which the web is running, the improvement comprising:

a. the fans being a pair of fans disposed one in each end of the drum;

b. a motor unit associated with each fan on which said fan is mounted; and c. actuation means for inserting said motor units and fans into the drum and withdrawing them therefrom to adjust the length of the zone over which the air is drawn through the web.

2. Apparatus according to claim 1 and further including a casing within said housing, said drum being disposed in said casing with the ends of said drum projecting therefrom.

3. Apparatus according to claim 2 wherein said drum has a circumferential outer flange rotating therewith and further including bearing rollers mounted on the wall of said casing supporting said outer flange.

4. Apparatus according to claim 3 wherein said casing includes an air inlet and further including heating means installed at said inlet.

5. Apparatus according to claim 1 wherein each motor unit is mounted on an adjustable linkage means.

6. Apparatus according to claim 5 wherein the actuating means for insertion of the fan unit comprises a screw spindle and a nut cooperating to move said linkage actuating the fan motor unit.

7. Apparatus according to claim 1 wherein said actuation means include a sensor which senses the position of the edge of the web, said sensor unit providing an output to control the movement of said motor unit and fan.

8. Apparatus according to claim 1 wherein said housing contains adjustable air inlet louvers and adjustable air outlet louvers.

9. Apparatus according to claim 8 wherein the ends of the drum lie in line with the outlet louvers in said housing.

10. Apparatus according to claim 8 wherein said air inlet louvers are in the lower part of the housing.

* * * * *